US007932862B2

(12) United States Patent
Tsai et al.

(10) Patent No.: US 7,932,862 B2
(45) Date of Patent: Apr. 26, 2011

(54) ANTENNA FOR A WIRELESS PERSONAL AREA NETWORK AND A WIRELESS LOCAL AREA NETWORK

(75) Inventors: Tiao-Hsing Tsai, Taiwan (TW); Chih-Wei Liao, Tao Yuan Shien (TW); Chao-Hsu Wu, Tao Yuan Shien (TW); Cheng-Hsiung Wu, Tao Yuan Shien (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 139 days.

(21) Appl. No.: 12/174,480

(22) Filed: Jul. 16, 2008

(65) Prior Publication Data

US 2009/0243938 A1 Oct. 1, 2009

(30) Foreign Application Priority Data

Apr. 1, 2008 (TW) ..... 97111857 A

(51) Int. Cl.
*H01Q 1/24* (2006.01)

(52) U.S. Cl. ..... 343/700 MS; 343/702; 343/795

(58) Field of Classification Search ..... 343/700 MS, 343/702, 795

See application file for complete search history.

(56) References Cited

U.S. PATENT DOCUMENTS

| | | | | |
|---|---|---|---|---|
| 3,030,622 | A * | 4/1962 | Leitner et al. | 343/793 |
| 4,513,292 | A * | 4/1985 | Bowman | 343/795 |
| 6,424,311 | B1 * | 7/2002 | Tsai et al. | 343/795 |
| 6,529,172 | B2 * | 3/2003 | Zimmerman | 343/797 |
| 6,714,162 | B1 * | 3/2004 | Kadambi et al. | 343/700 MS |
| 6,812,892 | B2 * | 11/2004 | Tai et al. | 343/700 MS |
| 6,906,678 | B2 * | 6/2005 | Chen | 343/795 |
| 6,937,196 | B2 * | 8/2005 | Korva | 343/702 |
| 7,271,771 | B2 | 9/2007 | Usui et al. | |
| 7,425,924 | B2 * | 9/2008 | Chung et al. | 343/702 |
| 7,602,341 | B2 * | 10/2009 | Wei-Shan et al. | 343/700 MS |

* cited by examiner

*Primary Examiner* — Tho G Phan
(74) *Attorney, Agent, or Firm* — Ladas & Parry, LLP

(57) ABSTRACT

An antenna includes a T-shaped radiating element and a coupling element. The radiating element includes opposite first and second radiating portions, and a feeding portion that extends transversely to the first and second radiating portions and that is connected to a junction of the first and second radiating portions. The coupling element is disposed between the second radiating portion and the feeding portion of the radiating element, and is coupled electromagnetically to at least one of the second radiating portion and the feeding portion of the radiating element.

9 Claims, 7 Drawing Sheets

Peak = 2.58 dBi, Avg. = -0.78 dBi.

Peak = 2.29 dBi, Avg. = -2.63 dBi.

Peak = 1.21 dBi, Avg. = -2.18 dBi.

Peak = -0.59 dBi, Avg. = -2.85 dBi.

Peak = -0.17 dBi, Avg. = -2.07 dBi.

Peak = 0.33 dBi, Avg. = -2.87 dBi.

Peak = 2.51 dBi, Avg. = -0.97 dBi.

Peak = 2.3 dBi, Avg. = -2.72 dBi.

Peak = 1 dBi, Avg. = -2.19 dBi.

Peak = 0.09 dBi, Avg. = -1.67 dBi.

Peak = 2.24 dBi, Avg. = -0.9 dBi.

Peak = 3.25 dBi, Avg. = -0.94 dBi.

ANTENNA FOR A WIRELESS PERSONAL AREA NETWORK AND A WIRELESS LOCAL AREA NETWORK

CROSS-REFERENCE TO RELATED APPLICATION

This application claims priority of Taiwanese application no. 097111857, filed on Apr. 1, 2008.

BACKGROUND OF THE INVENTION

1. Field of the Invention

This invention relates to an antenna, more particularly to an antenna that is applicable to a wireless personal area network (WPAN) and a wireless local area network (WLAN).

2. Description of the Related Art

In U.S. Pat. No. 7,271,771, there is disclosed a conventional antenna that is applicable to a wireless local area network (WLAN) and that is operable in 802.11a/b/g frequency ranges, i.e., from 2412 MHz to 2462 MHz and from 4900 MHz to 5875 MHz.

The aforementioned conventional antenna is disadvantageous in that it has a relatively large physical size and is not applicable to a wireless personal area network (WPAN).

SUMMARY OF THE INVENTION

Therefore, the object of the present invention is to provide an antenna that can overcome the aforesaid drawbacks of the prior art.

According to the present invention, an antenna comprises a T-shaped radiating element and a coupling element. The radiating element includes opposite first and second radiating portions, and a feeding portion that extends transversely to the first and second radiating portions. The feeding portion has a first end connected to a junction of the first and second radiating portions, and a second end opposite to the first end thereof and provided with a feeding point. The coupling element is disposed between the second radiating portion and the feeding portion of the radiating element, is coupled electromagnetically to at least one of the second radiating portion and the feeding portion of the radiating element, and has a grounding end.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
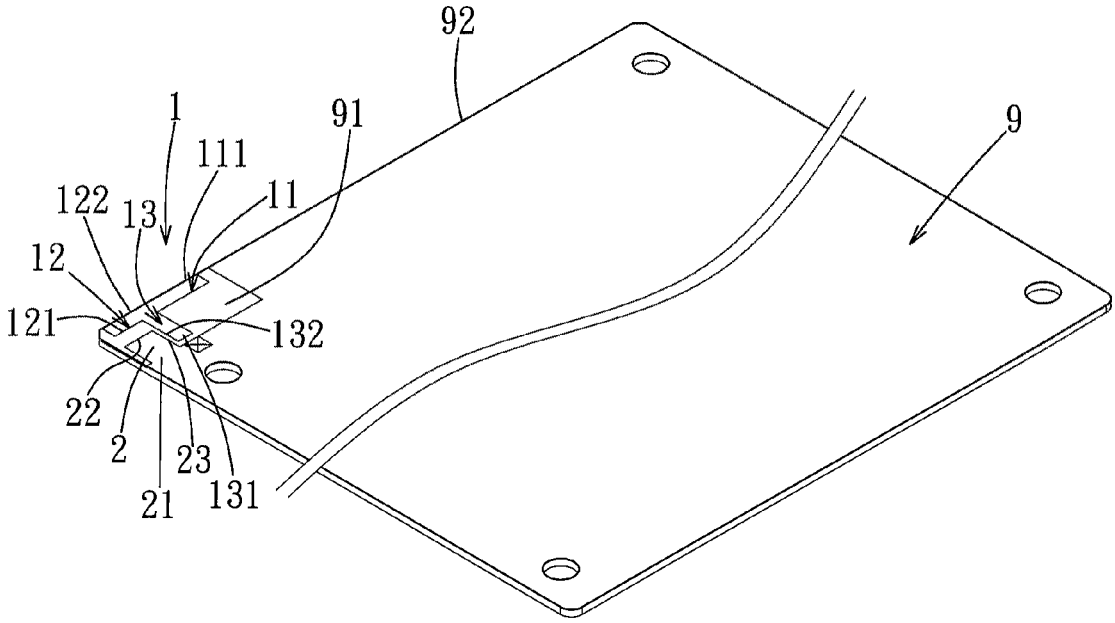
FIG. 1 is a perspective view of the preferred embodiment of an antenna according to this invention.

Referring to FIG. 1, the preferred embodiment of an antenna according to this invention is shown to include a T-shaped radiating element 1 and a coupling element 2.

The antenna of this invention is an ultra-wideband (UWB) antenna, has a relatively small physical size and a high gain, is applicable to a wireless local area network (WLAN) and a wireless personal area network (WPAN), and is operable in a 802.11b/g frequency range from 2412 MHz to 2462 MHz, a 802.11a frequency range from 4900 MHz to 5875 MHz, a Bluetooth frequency range from 2402 MHz to 2480 MHz, and a UWB Band I frequency range from 3168 MHz to 4752 MHz.

The antenna further includes a dielectric substrate 9 on which a circuit (not shown) is mounted.

The radiating element 1 is formed, such as by printing, on the dielectric substrate 9, and includes opposite first and second radiating portions 11, 12, and a feeding portion 13. The feeding portion 13 of the radiating element 1 extends transversely to the first and second radiating portions 11, 12, and has a first end that is connected to a junction of the first and second radiating portions 11, 12 of the radiating element 1, and a second end that is opposite to the first end thereof and that is provided with a feeding point 131. The feeding point 131 is connected to a transceiver (not shown) of the circuit. In this embodiment, the first radiating portion 11 of the radiating element 1 has a length longer than that of the second radiating portion 12 of the radiating element 1.

The coupling element 2 is formed, such as by printing, on the dielectric substrate 9, is disposed between the second radiating portion 12 and the feeding portion 13 of the radiating element 1, is coupled electromagnetically to the second radiating portion 12 and the feeding portion 13, and has a grounding end 21 connected to an electrical ground (not shown) of the circuit. In this embodiment, the coupling element 2 is generally rectangular in shape, and has adjacent sides 22, 23, each of which is disposed adjacent and parallel to a respective one of a side 121 of the second radiating portion 12 of the radiating element 1 and a side 132 of the feeding portion 13 of the radiating element 1.

In this embodiment, the first radiating portion 11 of the radiating element 1 operates in a first frequency range, and the second radiating portion 12 of the radiating element 1 cooperates with the coupling element 2 to operate in a second frequency range that overlaps a portion of the first frequency range. The first and second frequency ranges cover frequencies between 2000 MHz and 6000 MHz. Moreover, the first radiating portion 11 of the radiating element 1 has a length that may be lengthened to thereby widen a bandwidth in the first frequency range. Further, the feeding portion 13 of the radiating element 1 and the coupling element 2 define a distance therebetween that may be adjusted to obtain a desired impedance in the first frequency range. In addition, the second radiating portion 12 of the radiating element 1 and the coupling element 2 define a distance therebetween that may be adjusted to obtain a desired impedance in the second frequency range.

In an alternative embodiment, the first radiating portion 11 of the radiating element 1 has a configuration that is of the meander-line type.

It is noted herein that since the radiating element 1 and the coupling element 2 are printed on the dielectric substrate 9, the antenna of this invention is inexpensive to manufacture. Moreover, the radiating element 1 and the coupling element 2 is disposed at a corner 91 of the dielectric substrate 9, and each of the first and second radiating portions 11, 12 of the radiating element 1 has an edge 111, 122 flush with an edge 92 of the dielectric substrate 9. The construction as such prevents the antenna of this invention from electromagnetic interference of the circuit.

Figure 2:
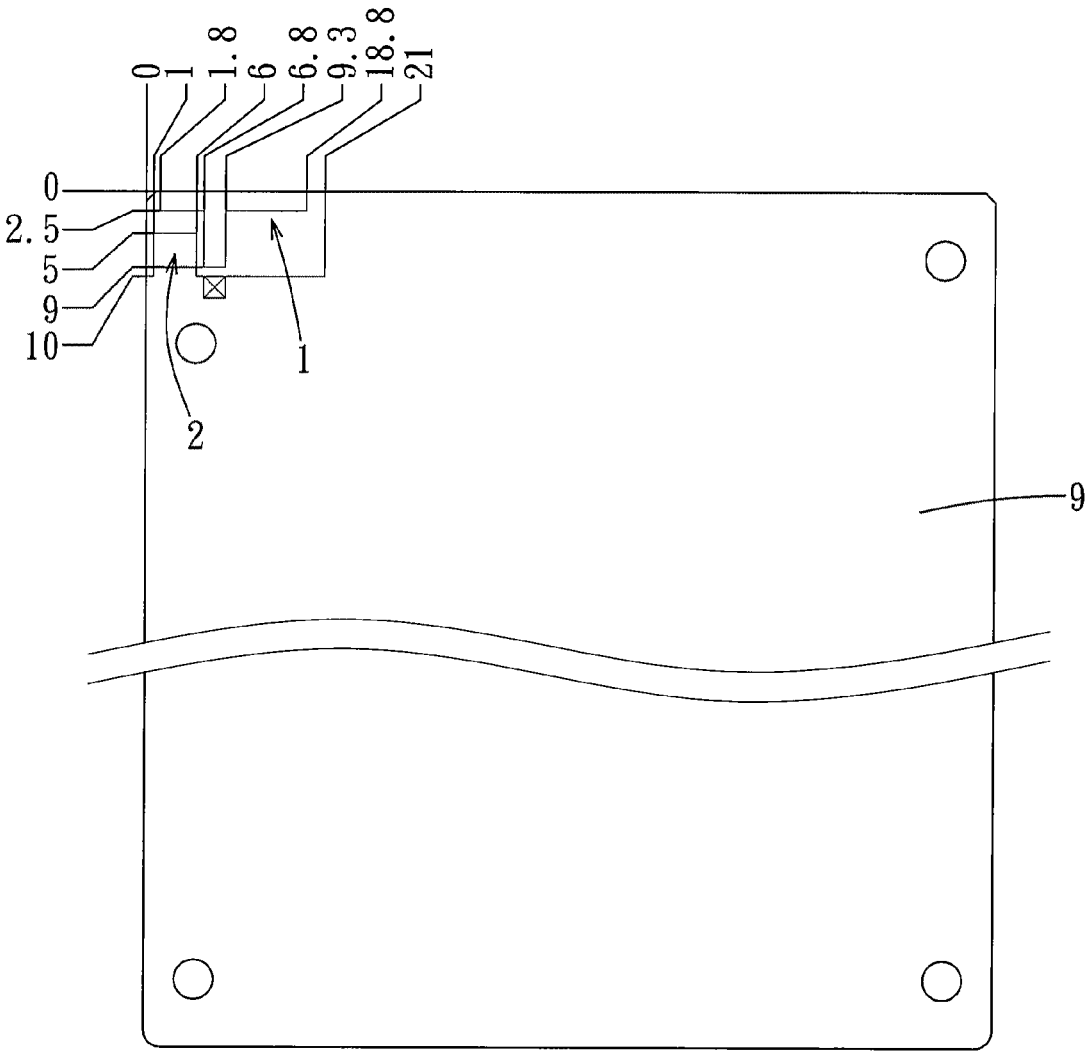
FIG. 2 is a schematic view illustrating dimensions (in millimeters) of the preferred embodiment.

As illustrated in FIG. 2, the antenna of this invention indeed has a relatively small physical size.

Figure 3:
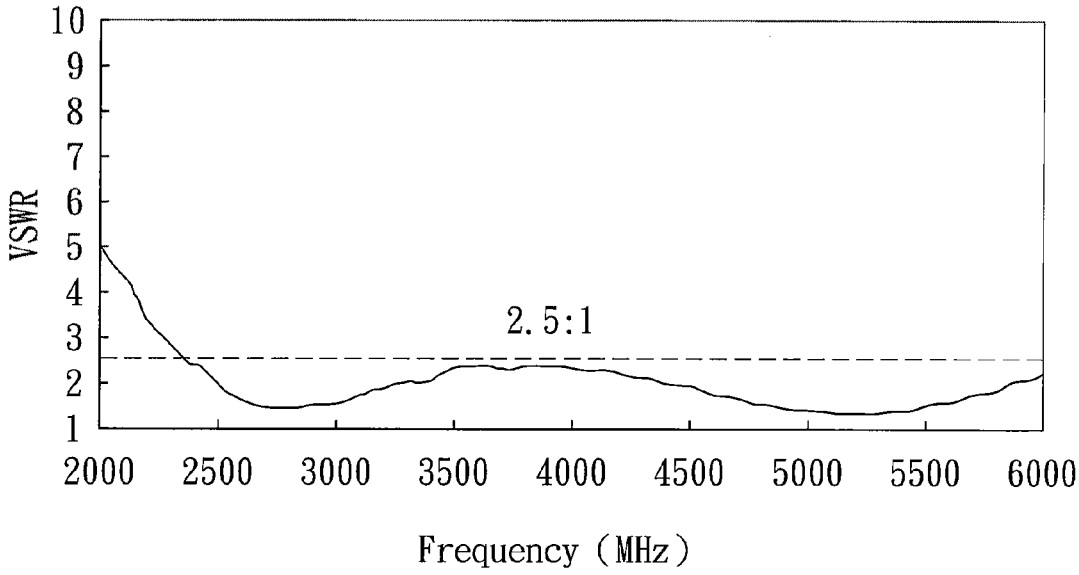
FIG. 3 is a plot illustrating a voltage standing wave ratio (VSWR) of the preferred embodiment.
Figure 4:
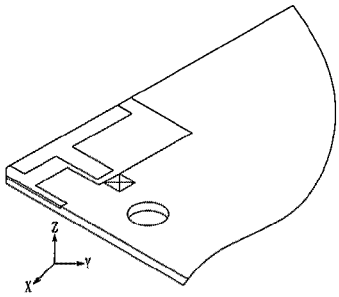
FIG. 4 shows plots of radiation patterns of the preferred embodiment respectively on the x-y, x-z, and y-z planes when operated at 2440 MHz.
Figure 4:
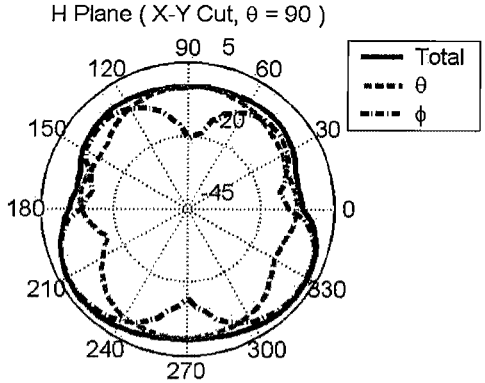
Figure 4:
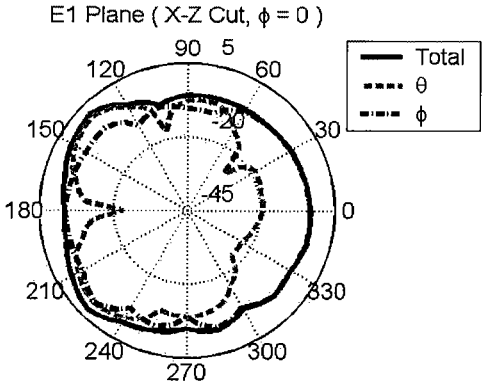
Figure 4:
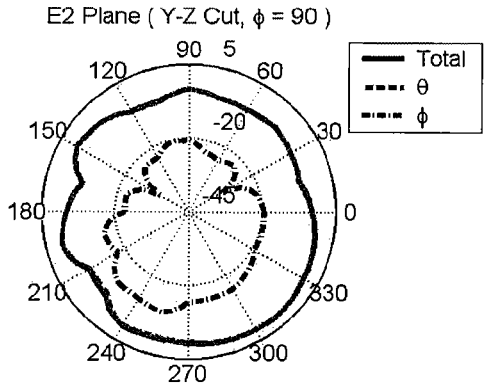
Figure 5:
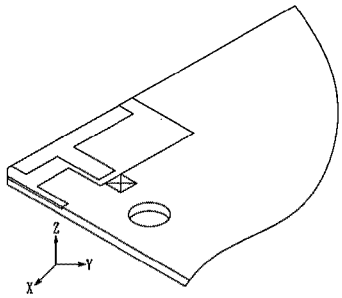
FIG. 5 shows plots of radiation patterns of the preferred embodiment respectively on the x-y, x-z, and y-z planes when operated at 4224 MHz.
Figure 5:
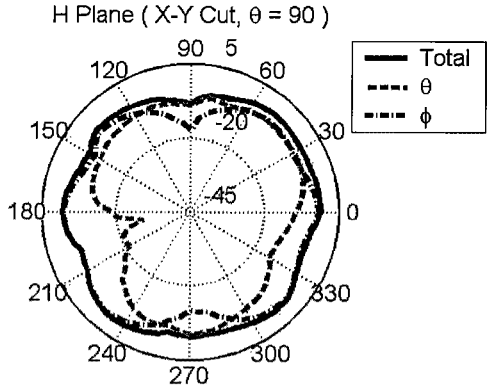
Figure 5:
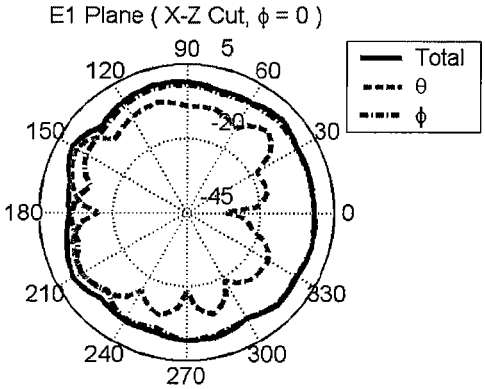
Figure 5:
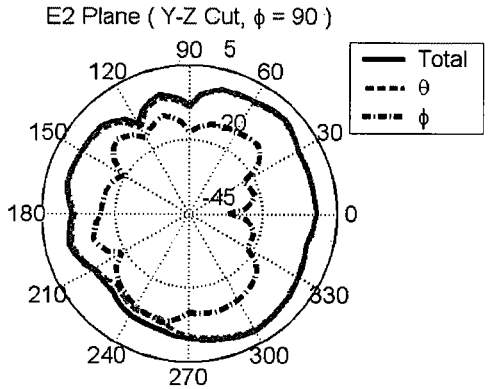
Figure 6:
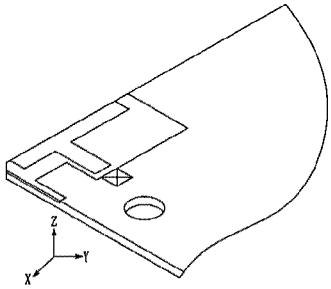
FIG. 6 shows plots of radiation patterns of the preferred embodiment respectively on the x-y, x-z, and y-z planes when operated at 2437 MHz.
Figure 6:
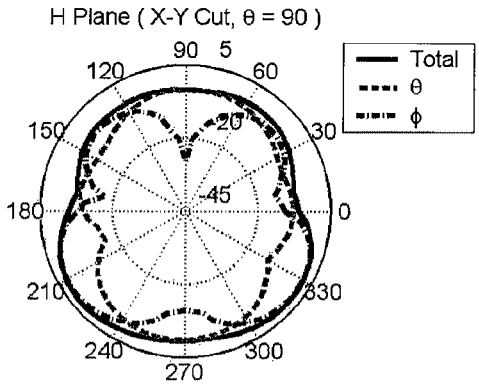
Figure 6:
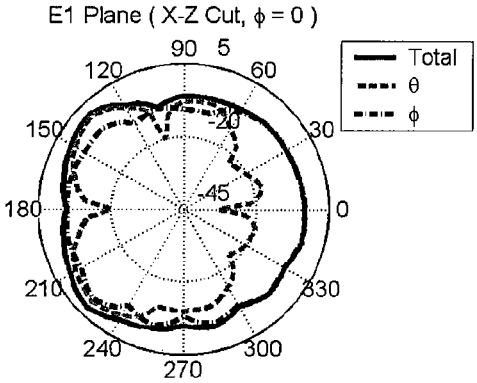
Figure 6:
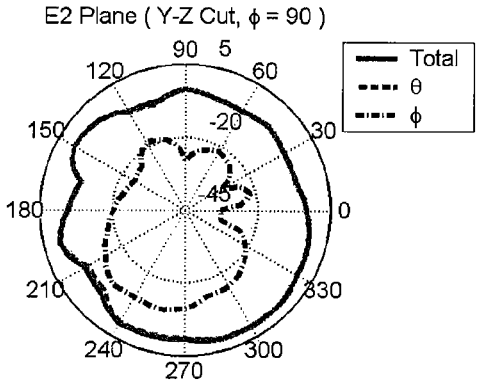
Figure 7:
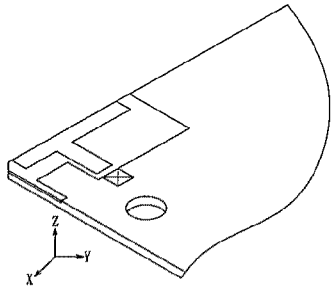
FIG. 7 shows plots of radiation patterns of the preferred embodiment respectively on the x-y, x-z, and y-z planes when operated at 5470 MHz.
Figure 7:
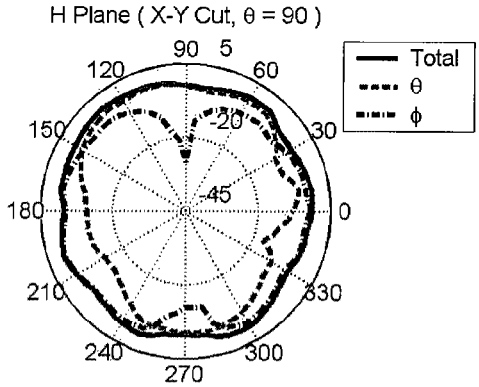
Figure 7:
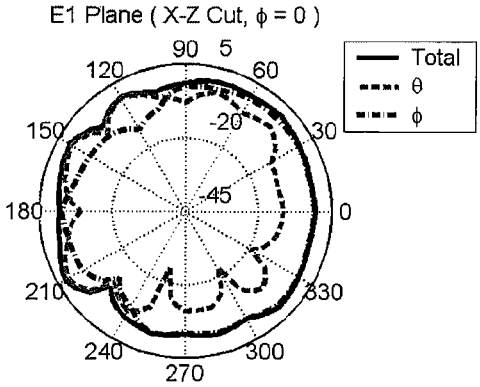
Figure 7:
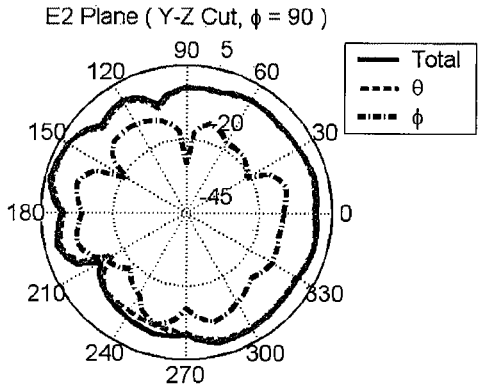

Experimental results, as illustrated in FIG. 3, show that the antenna of this invention achieves a voltage standing wave ratio (VSWR) of less than 2.5 when operated in the first and second frequency ranges. Moreover, the antenna of this invention has total radiation powers (TRPs) greater than −3 dBm and efficiencies greater than 50% when operated in the Bluetooth and UWB Band I frequency ranges, as shown in Table I, and the 802.11a/b/g frequency ranges, as shown in Table II. The antenna of this invention indeed has a high gain. Further, as illustrated in FIGS. 4 to 7, the antenna of this invention has substantially omnidirectional radiation patterns when operated at 2440 MHz, 4224 MHz, 2437 MHz, and 5470 MHz, respectively.

TABLE I

| Frequency (MHz) | TRP (dBm) | Efficiency (%) |
|---|---|---|
| 2402 | −1.90 | 64.52 |
| 2440 | −1.16 | 76.57 |
| 2480 | −0.90 | 81.19 |
| 3168 | −1.23 | 75.28 |
| 3432 | −1.74 | 67.00 |
| 3696 | −1.71 | 67.47 |
| 3960 | −1.50 | 70.87 |
| 4224 | −2.52 | 55.93 |
| 4488 | −2.85 | 51.84 |
| 4752 | −2.46 | 56.72 |

TABLE II

| Frequency (MHz) | TRP (dBm) | Efficiency (%) |
|---|---|---|
| 2412 | −1.78 | 66.33 |
| 2437 | −1.28 | 74.39 |
| 2462 | −0.94 | 80.62 |
| 4900 | −2.02 | 62.86 |
| 5150 | −1.31 | 73.94 |
| 5350 | −0.93 | 80.80 |
| 5470 | −1.27 | 74.59 |
| 5725 | −1.50 | 70.73 |
| 5875 | −2.12 | 61.32 |

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna comprising:

a T-shaped radiating element including opposite first and second radiating portions, and a feeding portion that extends transversely to said first and second radiating portions, said feeding portion having a first end connected to a junction of said first and second radiating portions, and a second end opposite to said first end thereof and provided with a feeding point; and a single coupling element disposed between said second radiating portion and said feeding portion of said radiating element, coupled electromagnetically to at least one of said second radiating portion and said feeding portion of said radiating element, and having a grounding end;

wherein said first radiating portion of said radiating element operates in a first frequency range without coupling with said coupling portion, and said second radiating portion of said radiating element cooperates with said coupling element to operate in a second frequency range.

2. The antenna as claimed in claim 1, further comprising a dielectric substrate on which said radiating element and said coupling element are printed.

3. The antenna as claimed in claim 2, wherein said dielectric substrate has an edge, and each of said first and second radiating portions has an edge flush with said edge of said dielectric substrate.

4. The antenna as claimed in claim 1, wherein said coupling element is generally rectangular in shape.

5. The antenna as claimed in claim 1, wherein said second radiating portion has a side, and said coupling element has a side that is adjacent and parallel to said side of said second radiating portion.

6. The antenna as claimed in claim 1, wherein said feeding portion has a side, and said coupling element has a side that is disposed adjacent and parallel to said side of said feeding portion.

7. The antenna as claimed in claim 1, wherein:

the second frequency range overlaps a portion of the first frequency range.

8. The antenna as claimed in claim 7, wherein the first and second frequency ranges cover frequencies between 2000 MHz and 6000 MHz.

9. The antenna as claimed in claim 7, wherein:

said feeding portion of said radiating element and said coupling element define a first distance therebetween that is set to obtain a desired impedance of said antenna in the first frequency range; and said second radiating portion of said radiating element and said coupling element define a second distance therebetween that is set to obtain a desired impedance of said antenna in the second frequency range.

* * * * *